US006585208B1

(12) United States Patent
Fraser

(10) Patent No.: US 6,585,208 B1
(45) Date of Patent: Jul. 1, 2003

(54) UNIVERSAL BRACKET FOR MOUNTING COVERINGS FOR ARCHITECTURAL OPENINGS

(75) Inventor: Donald E. Fraser, Owensboro, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/057,853

(22) Filed: Jan. 25, 2002

(51) Int. Cl.[7] ..... A47H 1/14
(52) U.S. Cl. ..... 248/251; 248/261
(58) Field of Search ..... 248/208, 251, 248/252, 255, 253, 261, 263, 266, 262, 271; 160/178.1 V

(56) References Cited

U.S. PATENT DOCUMENTS

| | | | | | |
|---|---|---|---|---|---|
| 926,181 | A | * | 6/1909 | Fish | 248/252 |
| 2,521,062 | A | * | 9/1950 | Hott | 248/252 |
| 4,254,813 | A | | 3/1981 | Vecchiarelli | |
| 4,607,818 | A | | 8/1986 | Georgopoulos | 248/251 |
| 4,745,732 | A | * | 5/1988 | Tisma | 53/564 |
| 4,802,644 | A | | 2/1989 | Oskam | 248/251 |
| 4,878,528 | A | | 11/1989 | Kobayashi | 248/262 |
| 5,060,710 | A | * | 10/1991 | Haarer | 160/178.1 R |
| 5,131,616 | A | | 7/1992 | Biba | |
| 5,441,230 | A | * | 8/1995 | Sambleson | 248/495 |
| 5,529,273 | A | | 6/1996 | Benthin | 248/254 |
| 5,533,560 | A | * | 7/1996 | Morris | 160/178.1 R |
| 5,915,806 | A | * | 6/1999 | Levee | 33/42 |

FOREIGN PATENT DOCUMENTS

WO WO 91/021135 * 2/1991

OTHER PUBLICATIONS

Hunter Douglas Product Catalogue, numbered as pp. 1–11.

* cited by examiner

*Primary Examiner*—Ramon O. Ramirez
(74) *Attorney, Agent, or Firm*—Dorsey & Whitney LLP

(57) ABSTRACT

A universal bracket assembly for mounting one or more coverings for architectural opening is described. The bracket assembly includes an L-shaped base with a vertical leg and an elongated horizontal leg. The vertical leg has one or more holes passing through it to secure the L-shaped base to a vertical surface such as a wall. The horizontal leg has a plurality of openings disposed on it for mounting the headrails of various coverings to it. In a preferred embodiment an elongated horizontal extension plate is also provided which can be attached to the horizontal leg of the L-shaped base. The extension plate includes openings disposed on it for mounting headrails of coverings thereto. In one variation either or both of the L-shaped base and the extension plate have rules marked on their surfaces so that a user can easily align the headrail between associated bracket assemblies.

27 Claims, 10 Drawing Sheets

UNIVERSAL BRACKET FOR MOUNTING COVERINGS FOR ARCHITECTURAL OPENINGS

FIELD OF THE INVENTION

This invention relates generally to architectural coverings, and more specifically to a universal mounting bracket for attaching architectural coverings to a supporting surface.

BACKGROUND OF THE INVENTION

Coverings for architectural openings are typically mounted to a supporting surface proximate a window or a doorway using two or more brackets supplied with the covering. Generally, the as-supplied brackets are designed specifically for a specific covering, providing a means for interfacing with and securing the headrail of the covering to the brackets. The brackets also include a means for attachment to a supporting surface proximate the opening that is to be covered. Typically this means comprises one or more holes in the bracket through which a fastener such as a screw may be passed and secured into the underlying supporting surface.

The design of many as-supplied brackets makes it necessary to attach the coverings within a recess, such as that of a window, by attaching the brackets either to a downwardly facing horizontal surface in the recess or to a vertical surface that is perpendicular to the associated interior wall. It can be appreciated that these limited mounting options greatly decrease the potential versatility of the architectural covering.

One particular situation that many as-supplied brackets are not designed to facilitate is the mounting of a covering such that it encompasses an entire window including the window recess. This is particularly the case with Venetian-style blinds and honeycomb-style shades which are generally supplied with brackets designed to mount to the horizontal top surface of a window recess or to the side surfaces of the recess.

Another common situation is covering an opening with two coverings. As-supplied brackets are not typically designed to facilitate this type of installation. Accordingly, an installer, using prior art mounting bracket technology, has to mount each covering separately, often jury rigging standard hardware store brackets to relocate one of the coverings relative to the other, since there is generally only enough space for a single covering within the recess of a standard window. Unfortunately, the result, although functional, may not be aesthetically pleasing or acceptable.

Additionally, a similar situation is encountered when one desires to install both an architectural opening covering and a facade or sophit to hide the headrail of the covering. Prior art technology required that both treatments be installed separately increasing the time and cost of an installation. Furthermore, the placement of the bracketry for both the facade and the sophit often require a high degree of ingenuity so that the facade can be placed in such a manner as to ensure it properly covers the headrail for the desired interior design effect.

BRIEF SUMMARY OF THE INVENTION

A bracket assembly for mounting a covering for an architectural opening to a vertical supporting surface is described. The bracket assembly typically comprises an L-shaped base with a vertical leg and an elongated horizontal leg. The horizontal leg includes opposing first and second longitudinal edges, a first lateral end that intersects with the vertical leg, a second lateral end opposite the first lateral end and substantially horizontal top and bottom surfaces. There are a plurality of vertically-extending openings disposed longitudinally and laterally on the second leg, wherein the openings are adapted to receive fasteners for mounting one or more architectural coverings. The vertical leg includes left and right opposing vertical edges, substantially vertical front and rear surfaces, and at least one horizontally-extending opening passing therethrough, wherein the opening is adapted for receiving a fastener to fixedly attach the L-shaped base to a vertical supporting surface. In a variation of the L-shaped base, a rule is marked on one of the top and bottom surfaces of the horizontal leg proximate one of the longitudinal edges. In yet another variation, the plurality of openings passing through the horizontal leg are longitudinally extending slots.

In an alternative embodiment, the bracket assembly further includes a substantially horizontal extension plate. The extension plate has opposing lateral and longitudinal edges bounding substantially horizontal top and bottom surfaces. A plurality of vertically-extending openings are disposed longitudinally and laterally through the extension plate. The openings are configured to receive fasteners for mounting one or more coverings for architectural openings to the bracket assembly.

DETAILED DESCRIPTION OF THE INVENTION

A universal bracket assembly for attaching most types of architectural covers to the supporting surface of a wall is described. The universal bracket assembly is generally of an "L"-shaped configuration and is adapted for (1) mounting to the supporting surface of a wall or frame of a window and (2) receiving the mounting brackets of various coverings for architectural openings, such as but not limited to Venetian blinds, vertical blinds, honeycomb shades, rollup shades and Silhouettes™, directly thereon. In an exemplary embodiment of the present invention, the universal bracket assembly can be utilized to attach and support two types of window coverings simultaneously. For instance, a pair of universal bracket assemblies can be attached to a supporting surface above a window, wherein both a window shade covering and a drapery-type covering are attached to the pair of universal brackets. Additionally, in the exemplary embodiment, a facade (or valence) can be attached to the bracket assembly as well to hide the headrails of the architectural coverings from view.

An assembled preferred embodiment of the universal bracket assembly is illustrated in FIGS. 1–8. An exploded view of the preferred embodiment is provided in FIG. 9 that illustrates the various components that comprise the bracket assembly. Finally, FIGS. 10–15 provide individual illustrations of the bracket assembly components.

Figure 9:
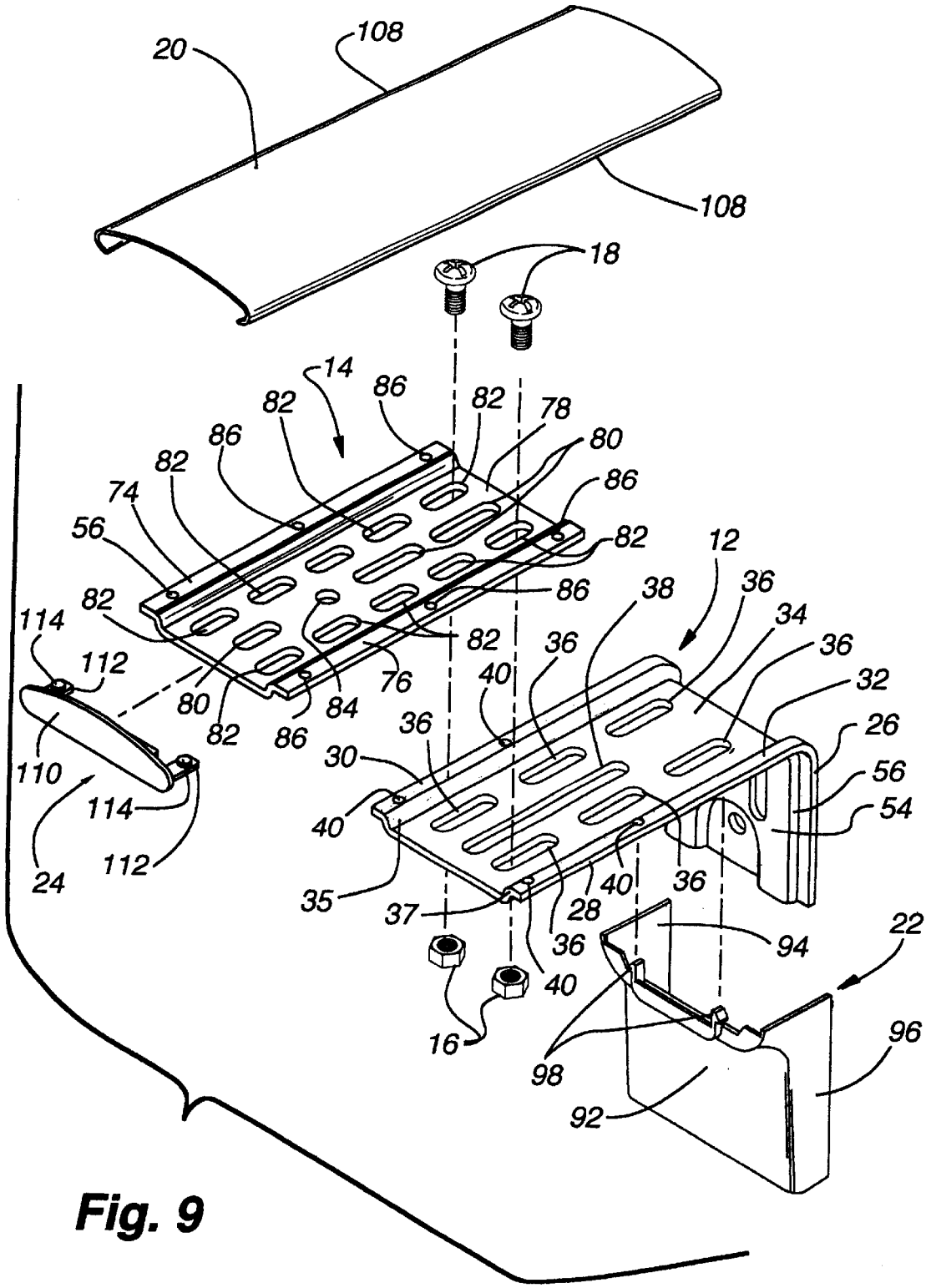
FIG. 9 is an exploded isometric view of the universal bracket assembly illustrating the component parts of the universal bracket.

Referring to FIG. 9, the universal bracket assembly 10 is comprised of a number of separate components that are all attached either directly or indirectly with an L-shaped base 12 including: (1) an extension plate 14 that is attached to the L-shaped base by nuts 16 and bolts 18; (2) an upper cover 20; (3) a lower cover 22; and (4) an end cover 24.

The L-shaped Base

The L-shaped base 12 is typically fabricated from a single piece of stamped steel to provide the necessary strength, although the bracket 12 can be made of other materials. In the preferred embodiment, 0.75" thick steel is utilized. The L-shaped base 12 includes a short leg 26 that is generally adapted for attachment to a vertical supporting surface such as an interior wall, and a long leg 28, which is generally horizontally disposed so that architectural coverings can be attached to it and supported thereby. In the preferred embodiment, the long leg 28 extends approximately 3.50" longitudinally and the short leg extends approximately 1.75" vertically with both legs being about 1.78" wide.

Figure 7:
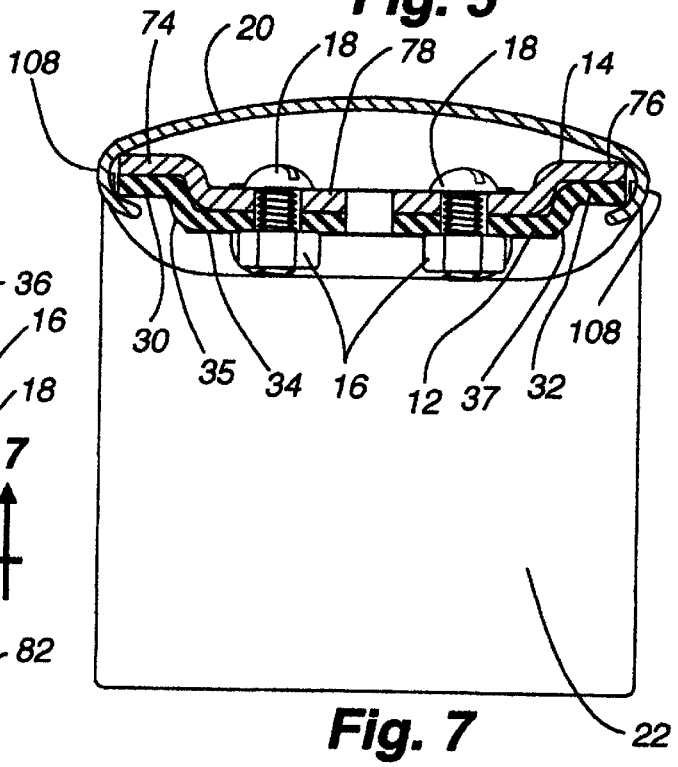
FIG. 7 is a cross sectional view of the universal bracket assembly taken along line 7—7 of FIG. 6.

Referring to FIGS. 7 & 9, the long leg 28 includes left and right flanges 30 and 32 that extend longitudinally along the left and right edges of the long leg and are vertically elevated relative to a center section 34 that also extends longitudinally. The flanges 30 and 32 and the center section 34 are joined by left and right web sections 35 and 37 that span the vertical displacement between the flanges 30 and 32 and the center section 34. In the preferred embodiment, the center section 34 is approximately 1.12" wide and is vertically offset from the right and left flanges 30 and 32 by about 0.20". This offset substantially increases the strength of the long leg 28 when compared to a similarly dimensioned long leg that has planer top and bottom surfaces. Accordingly, the long leg 28 of the L-shaped base 12 can accommodate relatively heavy loads such as those that might result when two architectural covers and a facade are attached to the L-shaped base.

Figure 11:
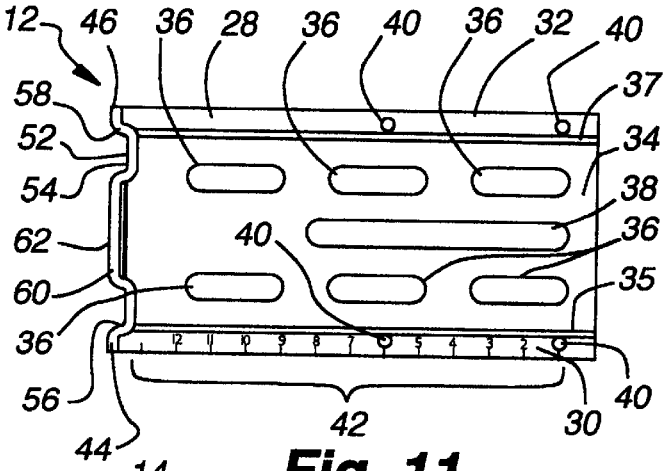
FIG. 11 is a bottom view of the L-shaped base.
Figure 12:
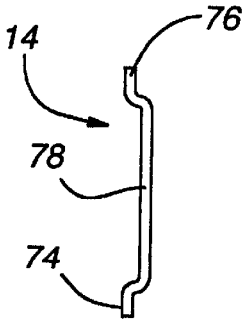
FIG. 12 is a side view of the extension plate of the universal bracket assembly.

Referring primarily to FIGS. 9 and 11, the center section 34 includes a plurality of longitudinally-extending slots 36 and 38 through which bolts and screws can be received to secure an architectural covering to the bracket assembly 10. The arrangement and configuration of the slots have been chosen to accommodate and be compatible with a substantial number of the coverings for architectural openings that are currently on the market. The preferred embodiment includes a single center slot 38 that is approximately 1.875" long disposed about the longitudinal center axis of the L-shaped base's long leg 28. Additionally, the preferred embodiment includes three pair of 0.70" long slots 36, wherein each slot of the pair is longitudinally aligned with its mate and is laterally spaced to the right or left of the longitudinal axis by about 0.39." Each pair of slots 36 are laterally aligned with the other two pairs of slots 36 and are spaced 0.32" from an adjacent pair(s) of slots. All of the slots 36 and 38 of the preferred embodiment are approximately 0.195" wide wherein they are capable of receiving both No. 6 and No. 8 screws.

The left and right flanges 30 and 32 also have several holes 40 passing through them for use when attaching a dust cover of a facade over the top of the L-shaped base 12 or for attaching the end cover 24 to the L-shaped base as is described in detail below. In the preferred embodiment, the holes 40 are 0.125" in diameter. Furthermore, a number of ruled lines 42 are stamped into the surface of one or both of the flanges 30 and 32 and can be utilized to help ensure an architectural covering is properly longitudinally aligned along the long leg 28 as compared to the longitudinal location of the covering at other L-shaped bases being utilized to mount the covering to a supporting surface. The ruled lines 42 can be graduated in any acceptable manner, whether in inches, centimeters or by some arbitrary unit of measure.

Figure 10:
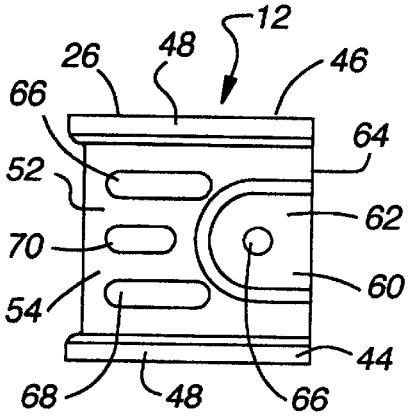
FIG. 10 is a rear end view of the L-shaped base of the universal bracket assembly.

Referring to FIGS. 10 and 11, the short leg 26 of the L-shaped base 12 includes vertically disposed left and right flanges 44 and 46 that extend along the vertical edges of the short leg 26. As shown, the rear surface 48 of each flange 44 and 46 is disposed rearwardly (to the left in FIG. 11) of the rear surface 52 of a center section 54 that is disposed along the vertical axis of the short leg 26. The flanges 44 and 46 are connected with the center section 54 by left and right webs 56 and 58. In the preferred embodiment; the center section 54 is horizontally offset from the flanges 44 and 46 by about 0.20". Additionally, a mounting section 60, which has a generally inverted U-shaped periphery, extends rearwardly relative to the center section 54 and has a mounting surface 62 that is coplanar with the rear surfaces 48 of the flanges 44 and 46. The mounting section 60 rises from the bottom edge 64 of the short leg 26 and extends vertically upwardly to a location below the vertical midpoint of the short leg 26. The mounting section 60 is symmetrically disposed about the vertical axis of the short leg 26 and includes a hole 66 located on the vertical axis for receiving a screw to secure the bracket assembly 10 to a vertical supporting surface, such as a wall. When mounted against a vertical supporting surface, the short leg's left and right flange rear surface 48 and the mounting surface 62 are all in contact with the vertical supporting surface, thereby providing a relatively large area to transfer the weight of the coverings attached to the bracket assembly 10 to the vertical supporting surface. In the preferred embodiment, the mounting section 60 is approximately 0.63" wide and the hole 66 passing through it is 0.195" in diameter.

Referring to FIG. 10, the center section 54 of the short leg 26 includes three vertically extending slots 68 and 70, wherein the top ends of all three slots are vertically aligned with each other. The left and right slots 68 are each disposed about 0.39" from the vertical center axis and are of similar length. The center slot 70 is shorter than the left and right slots 68 and is disposed along the vertical axis of the short leg 26. In the preferred embodiment, the top of each of the slots 68 and 70 is spaced approximately 0.28" below the top surface of the left and right flanges 30 and 32 of the long leg 28, and each of the slots 68 and 70 is 0.195" wide. The center slot 70 is 0.500" long and the right and left slots 68 are each 0.75" long. As with the slots 36 and 38 in the long leg 28, the slots 68 and 70 on the short leg 26 are for use in securing architectural coverings to the universal bracket assembly 10. Because the rear surface 52 of the center section 54 is recessed longitudinally around 0.2" from the rear surfaces 48 of the flanges 44 and 46 and the mounting surface 62 of the mounting section 60, a nut can be placed within the recess about the slots 68 and 70 to hold a bolt or screw in place when the slots of the short leg 26 are being utilized.

Extension Plate

Figure 6:
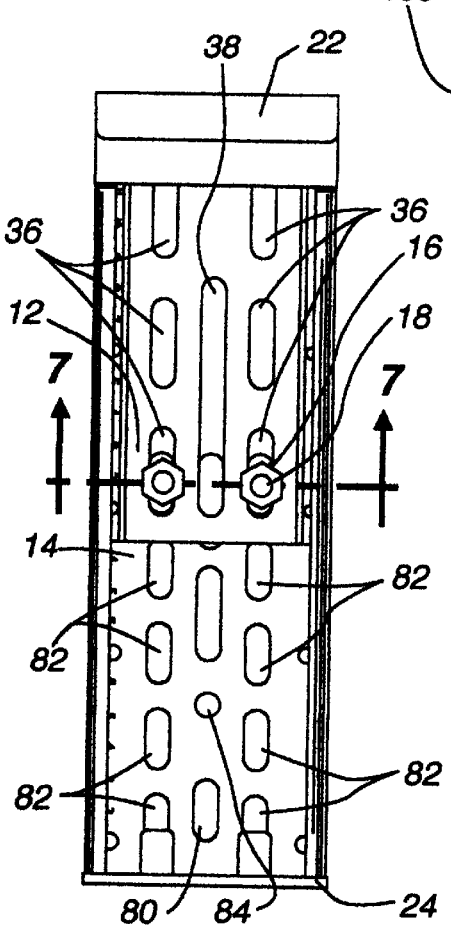
FIG. 6 is a bottom view of the universal bracket assembly.

Referring to FIGS. 6, 7 and 9, the extension plate 14 can be attached to the long leg 28 to extend the longitudinal span of the universal bracket assembly, which may be necessary when more than one architectural covering is to be attached to the bracket assembly 10. In the preferred embodiment, the extension plate 14 is 3" long and is fabricated from 0.075" thick stamped steel. Top and side views of the extension plate 14 are provided in FIGS. 12 and 13. As can be seen in FIG. 7 the extension plate 14 has a lateral cross section similar to the cross section of the long leg 28 with left and right flanges 74 and 76 that are elevated vertically above a center section 78. Accordingly, the lower surface of the extension plate 14 nests against the upper surface of the long leg 28 as best shown in FIG. 7.

Figure 13:
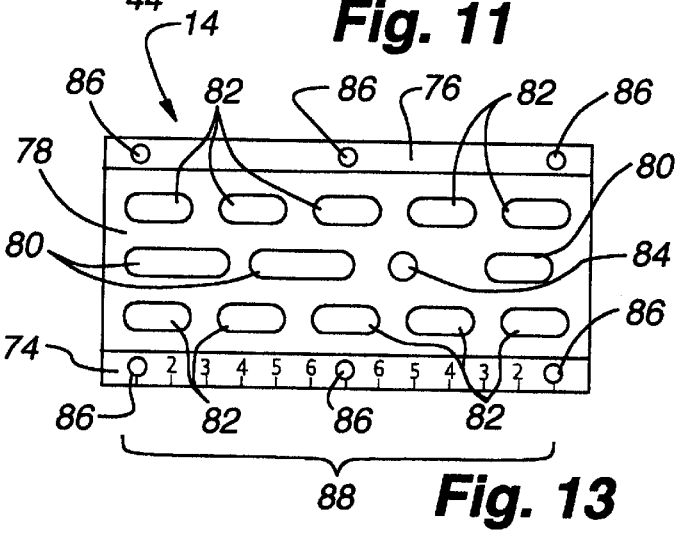
FIG. 13 is a bottom view of the extension plate.

Referring specifically to FIG. 13, the extension plate 14 includes a plurality of longitudinally extending slots 80 and 82 disposed on its center section 78. In the preferred embodiment, the extension plate 14 includes three center slots 80 that are disposed along the longitudinal axis of the extension plate. From the left, as viewed in FIG. 13, a 0.75" long first center slot 80 is spaced about 0.15" from the left edge of the extension plate. A second longitudinally-aligned center slot 80, also approximately 0.75" long, is longitudinally spaced about 0.50" from the first slot, and a 0.50" long third longitudinally-aligned slot 80 is longitudinally spaced about 0.75" from the second slot. Additionally, a 0.195" hole 84 passes through the center section 78 on the longitudinal axis between the second and third center slots 80, approximately 0.050" to the right of the second slot. Additionally, the preferred embodiment of the extension plate 14 includes five pair of approximately 0.48" long slots 82, wherein each slot of the pair is transversely aligned with its mate and laterally spaced to the right or left of the longitudinal axis by about 0.39." Each pair of slots 82 is longitudinally aligned with the other four pairs of slots and is spaced about 0.20" from an adjacent pair(s) of slots 82 with the leftmost pair of slots being spaced from the left edge by about 0.15". All of the slots 80 and 82 of the preferred embodiment of the extension plate are approximately 0.195" wide, wherein they are capable of receiving both No. 6 and No. 8 screws.

Like the right and left flanges 30 and 32 of the long leg 28, the left and right flanges 74 and 76 of the extension plate also have several holes 86 passing through them for use when attaching a dust cover of a facade over the top of universal bracket assembly 10 or for attaching the end cover 24 to the extension plate 14 as is described in detail below. In the preferred embodiment, three 0.125" diameter aligned holes 86 are provided on each flange 74 and 76, wherein the leftmost hole is located 0.15" from the left edge of the extension plate, the rightmost hole is located 0.15" from the right edge, and the third hole is located on the lateral center axis of the extension plate. Furthermore, as with the long leg of the L-shaped base numbered ruler lines 88 are stamped into the surface of one or both of the flanges 74 and 76 that can be utilized to help ensure an architectural covering is properly longitudinally aligned along the extension plate 14 as compared to the longitudinal location of the architectural covering at other extension plate s 14 being utilized to mount the covering to a vertical supporting surface. The ruled lines 88 can be graduated in any acceptable manner, whether in inches, centimeters or by some arbitrary unit of measure.

The extension plate 14 is attached to the long leg 28 of the L-shaped base 12 as illustrated in FIGS. 6 and 7. The extension plate 14 is typically disposed on top of the long leg 28 wherein a pair of slots 82 from the base plate and a pair of slots 36 from the extension plate are at least partially aligned in an overlying relationship. A bolt or screw is passed through both the left and right aligned slots 68 and 82 and secured with a nut. Depending on how the slots are aligned, the amount of extension of the universal bracket assembly 10 as measured from the mounting surface 62 of the L-shaped base 12 can be varied. In certain circumstances, more than one pair of slots from each bracket piece may be aligned with additional screw or bolts being utilized to secure the extension plate 14 to the L-shaped base 12. Furthermore, although the extension plate is illustrated as being mounted to the top surface of the long leg 28, it is to be appreciated that the extension plate 14 could also be mounted to the bottom surface of the long leg.

Cover Pieces

Figure 1:
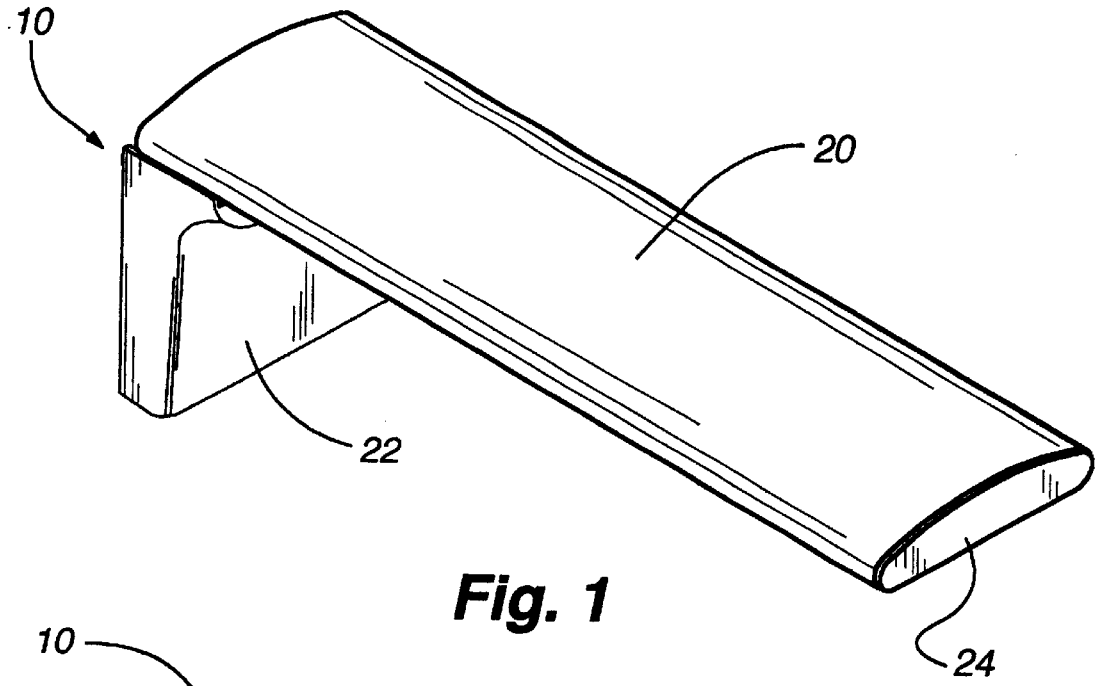
FIG. 1 is an isometric side view of an assembled universal bracket assembly according to one embodiment of the present invention
Figure 2:
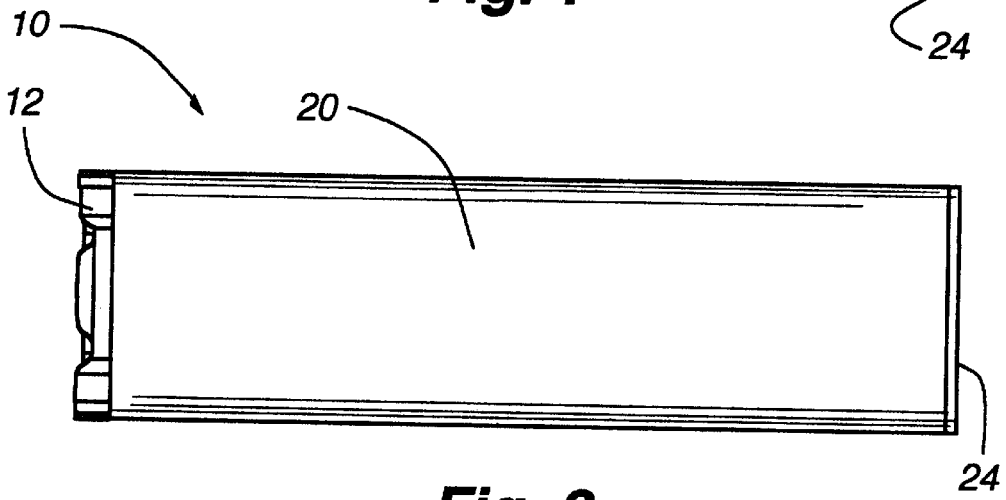
FIG. 2 is a top view of the universal bracket assembly.
Figure 3:
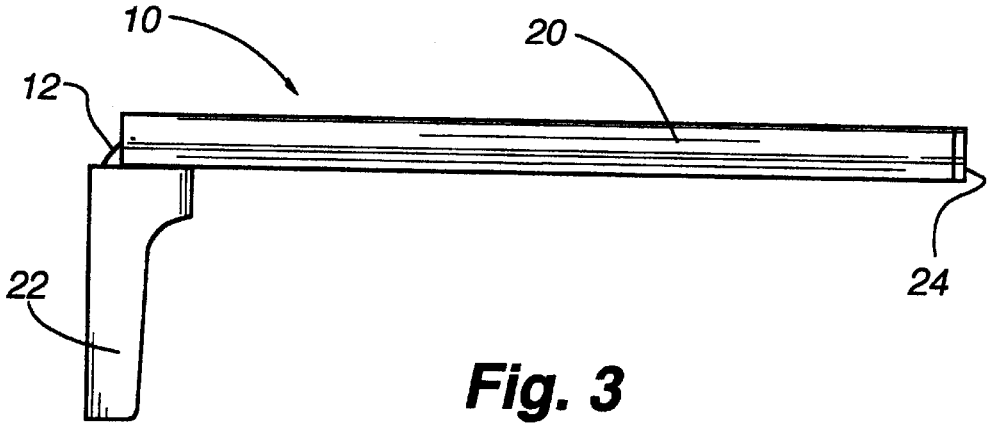
FIG. 3 is a side view of the universal bracket assembly.
Figure 4:
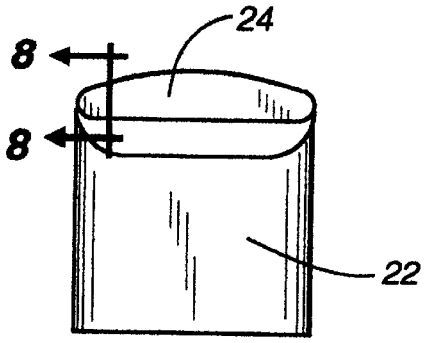
FIG. 4 is an front view of a universal bracket assembly.

Referring to FIG. 9, three cover pieces are provided that can be attached to the L-shaped base 12 and/or the extension plate 14 to hide them from view, making the bracket assembly 10 more aesthetically pleasing. It is to be appreciated that depending on the application in which the universal bracket assembly 10 is utilized some or all of the cover pieces may or may not be installed. For instance, the top cover 20 may not be used when the bracket assembly is not visible from above. Generally, the cover pieces are molded from a plastic material, such as polycarbonate, in a neutral color, such as ivory. They are designed to be easily snap fit over the L-shaped base 12 or the extension plate 14 after the bracket assembly has been installed onto a vertical supporting surface and the architectural coverings have been attached to the bracket assembly. FIGS. 1–3 illustrate a universal bracket assembly 10 with all three cover pieces installed.

Figure 14:
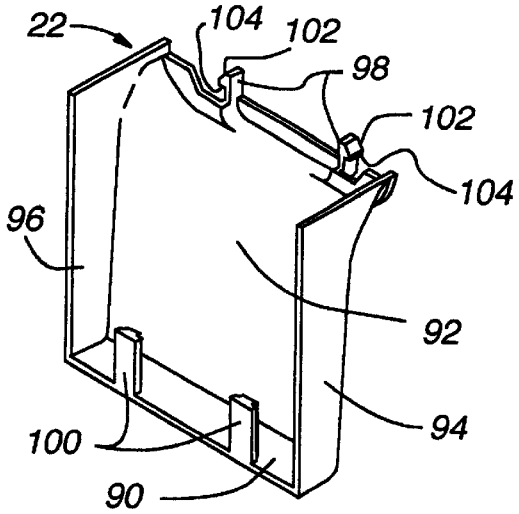
FIG. 14 is an isometric rear view of the lower cover of the universal bracket assembly.

Referring to FIGS. 9 and 14, the lower cover 22 is designed to fit over and cover the short leg 26 portion of the L-shaped base 12. The lower cover 22 includes (1) a downwardly facing bottom side 90 that abuts the vertical supporting surface to which the L-shaped base is mounted on a rear edge and (2) a substantially vertical front side 92 extending upwardly from its front edge. A pair of left and right sides 94 and 96 extend vertically from the left and right edges of the bottom side 90 and intersect the left and right edges of the front side 92 at one edge and butt against the vertical supporting surface at a rear edge. As can be appreciated, the bottom, left and right sides 90, 94 and 96 extend horizontally from their rear edges a distance at least slightly greater than the horizontal distance between a front surface of the short leg center section 54 and the mounting surface 62 of the mounting section 60. The front side 92 of the lower cover 22 flares outwardly proximate its top end, wherein it terminates at a top edge.

Figure 5:
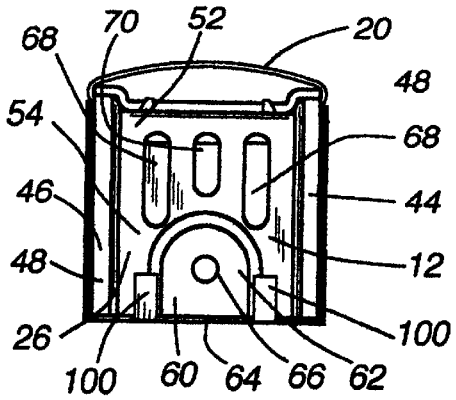
FIG. 5 is rear view of the universal bracket assembly.

The lower cover 22 is attached to the L-shaped base 12 by way of (1) a pair of catch arms 98 that extend upwardly from the top edge of the front side 92 and (2) a pair of arms 100 that extend upwardly from the rear edge of the bottom side 90. Each catch arm 98 of the pair is passed through either the left or right slot of the rearmost pair of slots 36 on the long leg 28, wherein a beveled surface 102 at the top of each arm 98 resiliently encourages the arm in a lateral direction towards the longitudinal axis. Once a horizontal catch 104 passes through its respective slot 36, the catch arm 98 springs back into its normal at rest position with the horizontal catch 104 abutting the top surface of the long leg center section 34, thereby securing the lower cover 22 in place. Simultaneously, as the catch legs 98 are passed through the pair of slots 36, the pair of vertical arms 100 at the rear edge of the bottom side 90 are passed behind the rear surface of the bottom portion of the center section 54 of the short leg 26. Accordingly, when the catch arms 98 are secured against the long leg 28, the pair of legs 100 are sandwiched between the vertical supporting surface and the rear surface of the short leg's center section 54 as shown in FIG. 5, thereby preventing the lower cover 22 from swinging outwardly away from the vertical supporting surface and the short leg 26 about the catch arms 100.

Referring to FIG. 9, the top cover 20 comprises an elongated slightly arcuate and convex top surface 106 that curves under proximate its longitudinal edges 108. The top cover 20 is resilient, whereby the cover can be flexed as necessary to secure the curved under longitudinal edges 108 around the opposing longitudinal edges of the long leg 28 and/or the extension plate 14 as shown in FIG. 7. The top cover 20 can be provided in a variety of lengths for use with or without the extension plate 14 and for use with various amounts of extension. Alternatively, the top cover 20 can be provided in a standard length generally equivalent to the length of long leg 28 with an extension plate 14 attached thereto at its maximum extension, wherein an installer can cut the top cover 20 into shorter lengths as necessary to match the as-installed configuration of the universal bracket assembly 10. As will be described below in greater detail, the top cover 20 may not be utilized in all embodiments of the invention. For instance, when a facade having a dust cover is attached to the universal bracket assembly, the dust cover replaces and performs the general function of the top cover making the top cover unnecessary.

Figure 8:
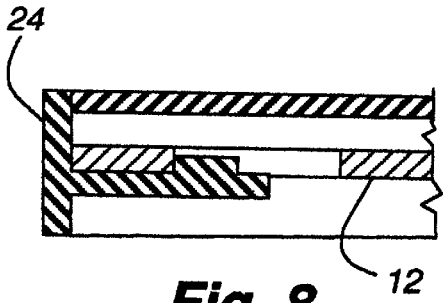
FIG. 8 is a cross sectional view of end cover mounted to the universal bracket assembly taken along lines 8—8 of FIG. 5.
Figure 15:
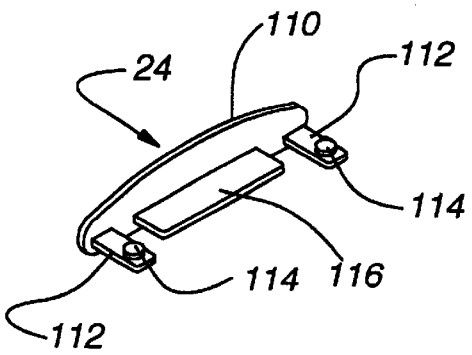
FIG. 15 is a isometric rear view of the end cover of the universal bracket assembly.

Referring to FIGS. 8, 9 and 15, the end cap 22 comprises a vertically orientated front face 110 having an arcuate top edge that is similar to the arcuate cross section of the top cover 20 and matches up against the top surface of the top cover when installed on the universal bracket assembly. A pair of resilient horizontal catch arms 112 that are disposed proximate either lateral end of the cover's front face extend rearwardly from the front face 110. The catch arms 112 each have a cylindrical nubbin 114 that extends upwardly from the top surface of the catch arm near the distal end of the catch arm. Also extending rearwardly from the front face 110 is a rectangular horizontal ear 116 that is disposed about the lateral center of the front cover and is substantially coplanar with the horizontal catch arms 112. In the rig preferred embodiment the ear is about 1.00" wide, which is similar in dimension to the width of center sections of both the long leg and the extension plate. When installed, the horizontal ear 116 rests upon the top surface of the center section of either the long leg or the extension plate depending on the configuration of the universal bracket assembly being utilized. The catch arms 112 are encouraged against the bottom surface of the associated opposing flanges with the nubbin 114 of each arm being received into the outermost hole 40 or 86 in the corresponding flange. Accordingly, the ear 116 and the catch arms 112 are braced against the top surface of the center section and the bottom surface of the flanges respectively to hold the front face 110 vertically at the end of the universal bracket assembly, wherein the nubbins 114 coupled with the resilient catch arms 112 act to secure the front cover from being pulled or falling off the end of the universal bracket assembly 10.

Utilization of the Universal Bracket

As described earlier, the universal bracket assembly 10 can be utilized to attach a number of different types of architectural coverings to a vertical supporting surface, such as a wall. Normally, architectural coverings are supplied with brackets that interface with the headrail of the covering and have holes therein so that the brackets may be screwed into a wall or frame of a window. The design of many brackets makes it necessary to attach the brackets within a window recess either to a downwardly facing horizontal surface in the recess or to a vertical surface that is perpendicular to the associated interior wall. It can be appreciated that these limited mounting options greatly decrease the potential versatility of the architectural covering. One particular situation that many as-supplied brackets are not designed to facilitate is the mounting of a covering such that it encompasses an entire window including the window recess. Another common situation is when two covers are to cover the same window. As supplied brackets are not typically designed to be installed in tandem with another covering, such as when, for example, a person desires to have a window covered with both a honeycomb shade and a pair of drapes. Prior to the universal bracket, an installer would have to mount each covering separately often jury rigging several brackets to provide both a functional and aesthetically pleasing result. Although the universal bracket does not necessarily replace the brackets supplied with various architectural coverings, it does provide alternative mounting locations for the supplied brackets increasing the situations in which a covering can be used. FIGS. 16–27 illustrate how the universal bracket can be utilized in conjunction with several architectural covering systems.

Figure 16:
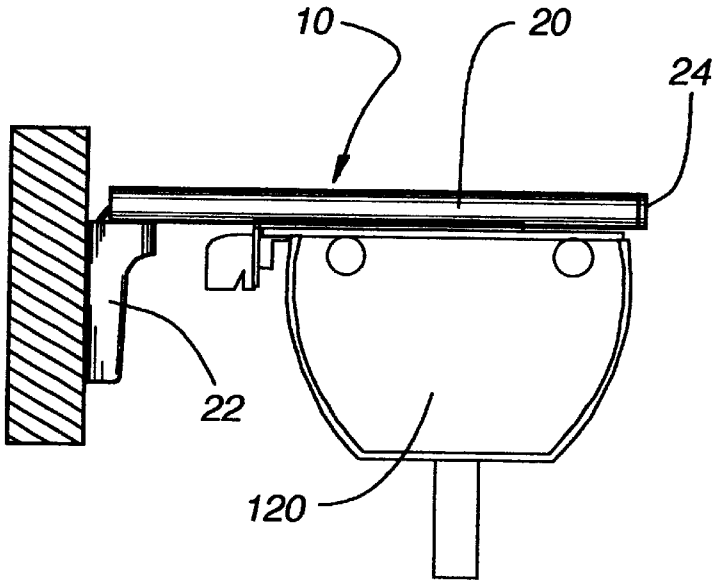
FIG. 16 is an end view of a headrail of a vertical blind assembly mounted to a vertical supporting surface using the universal bracket assembly.
Figure 17:
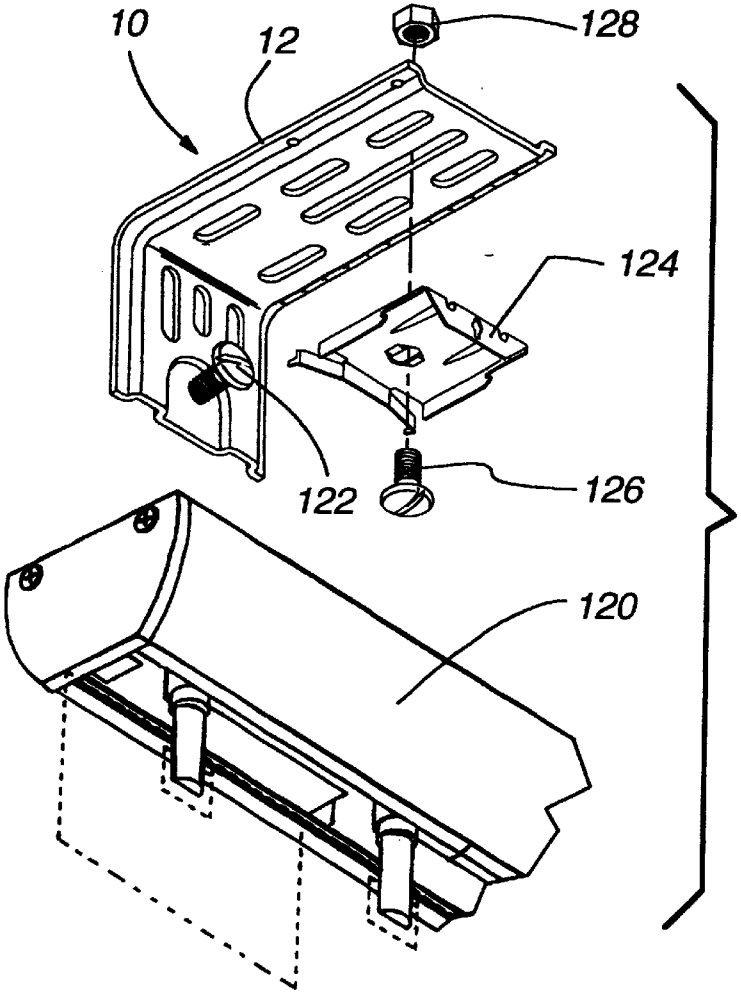
FIG. 17 is an exploded isometric view illustrating the manner in which the vertical blind headrail is mounted to the vertical supporting surface using the universal bracket assembly.

FIGS. 16 and 17 illustrate a headrail 120 of a vertical blind assembly attached to an embodiment of the universal bracket 10. As is appreciated, at least two universal bracket assemblies are utilized to attach a single covering assembly to a vertical supporting surface, wherein the bracket assemblies 10 are typically located proximate the ends of the coverings. The short leg 26 of the L-shaped base 12 is attached to a vertical supporting surface using a single fastener 122 mounted through the mounting hole 66. The bracket 124 supplied with the vertical blind assembly 120 is mounted to the long leg 28 of the L-shaped base 12 through the center slot 38 using a screw fastener 126 and a nut 128. The headrail 120 is snapped into place over the as-supplied brackets 124 to attach the vertical blind assembly to the universal bracket assemblies. The lower, top and end coverings 20, 22 and 24 can be installed as shown in FIG. 16 to give the bracket assembly 10 a more refined and aesthetically pleasing look.

Figure 18:
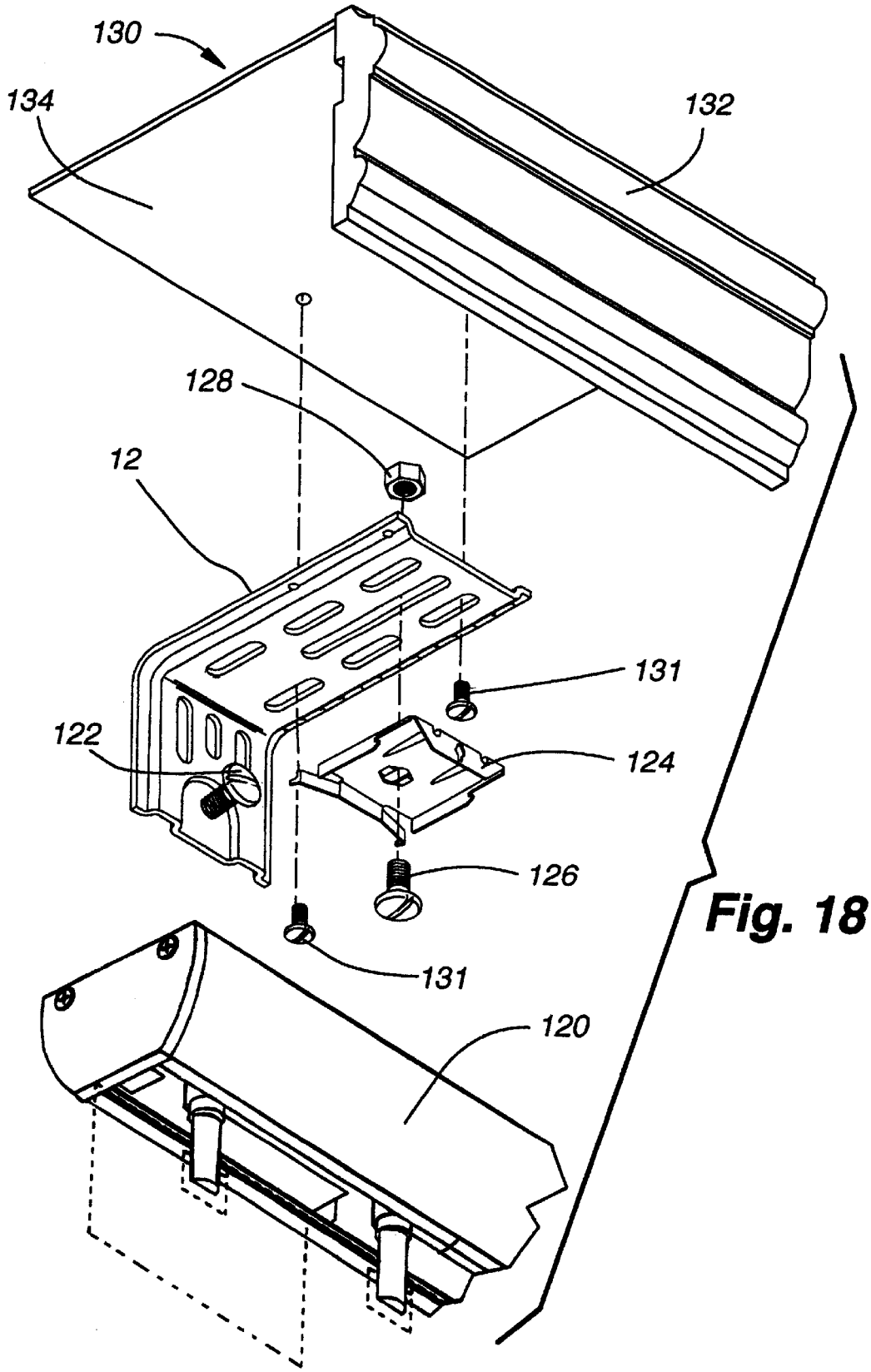
FIG. 18 is an exploded isometric view similar to FIG. 17 illustrating the manner in which a facade can be attached to the universal bracket assembly.
Figure 19:
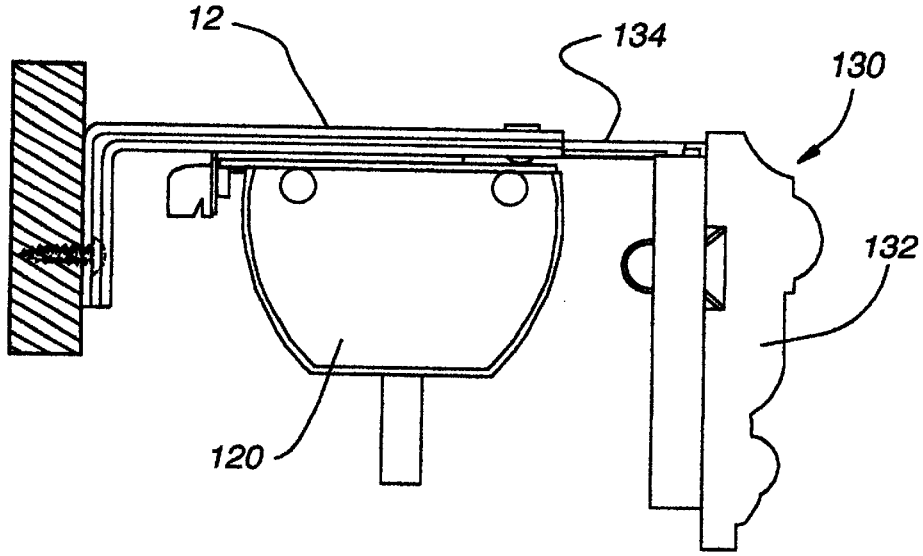
FIG. 19 is an end view of a headrail of a vertical blind assembly mounted to a vertical supporting surface using the universal bracket assembly with a facade attached to the universal bracket assembly.

FIGS. 18–19 illustrate the headrail 120 of a vertical blind assembly similar to the assembly illustrated in FIGS. 16 and 17 that is attached to a variation of the universal bracket assembly 10 that also incorporates a facade to cover and hide the headrail 120 from view. As shown, the short leg 26 of the L-shaped base 12 is attached to the vertical supporting surface with a single fastener 122. The as-supplied bracket 124 for the vertical blind assembly is attached to the long leg 28 of the L-shaped base through the center slot 38 via a fastener 126 and a nut 128. A facade (or valance) assembly 130 comprises (1) vertically orientated decorative molding 132, and (2) a horizontal dust cover 134 that extends horizontally and rearwardly from the decorative molding 132 near the molding's top end. The dust cover 134 of the facade assembly 130, which typically spans a length similar to the length of the blind assembly, is attached to each bracket assembly through the dust cover holes 40 in the flanges 30 and 32 of the long leg 28 using several fasteners 131. The lower cover 22 (not shown) can be secured to the short leg 26 if desired, although the decorative molding 132 will generally hide the short leg of the universal bracket assembly from view.

Figure 20:
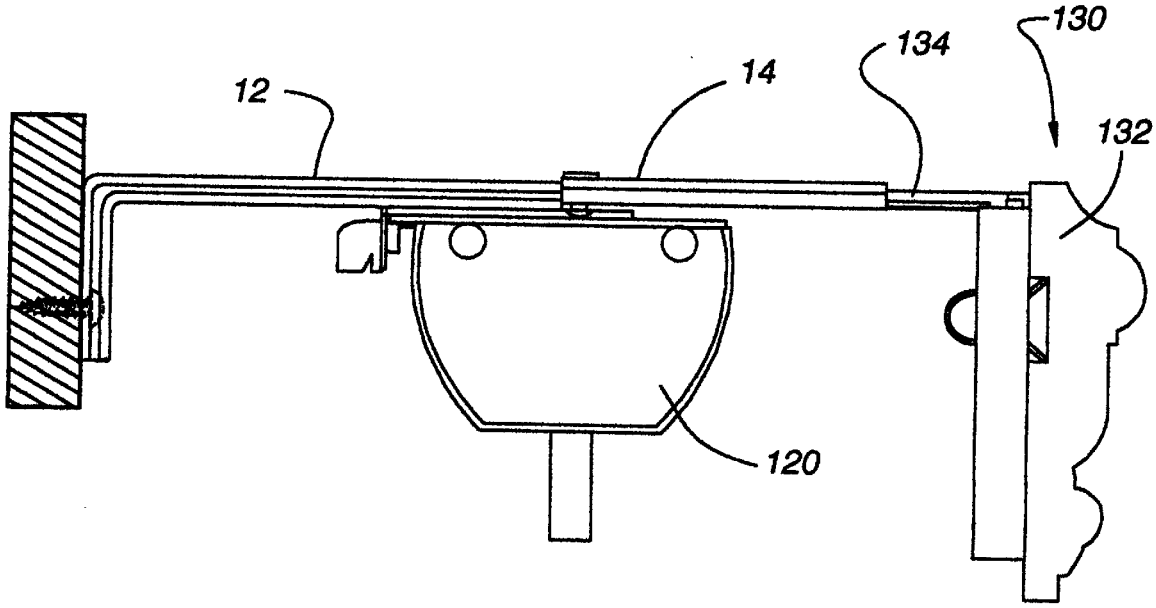
FIG. 20 is an end view of a vertical blind headrail attached to the universal bracket assembly similar to FIG. 19 except the extension plate of the universal bracket assembly is shown facilitating the attachment of the headrail and the facade a greater distance from the vertical supporting surface than is shown in FIG. 19.

FIG. 20 illustrates a headrail 120 of a vertical blind assembly mounted to another variation of the universal bracket assembly 10, wherein the extension plate 14 is utilized in conjunction with the facade assembly 130. As shown, the headrail 120 is mounted proximate the end of the L-shaped base 12 at the overlap with the extension plate 14. The facade assembly 130 is then attached to the bracket assembly 10 using screws or fasteners passing through the dust cover holes 40 and 86 of either or both sets of flanges of the L-shaped base 12 and the extension plate 14. It is to be appreciated that by using the extension plate, the headrail 120 and the decorative molding 132 may be situated a greater distance from the vertical supporting surface as may be desired in certain situations.

Figure 21:
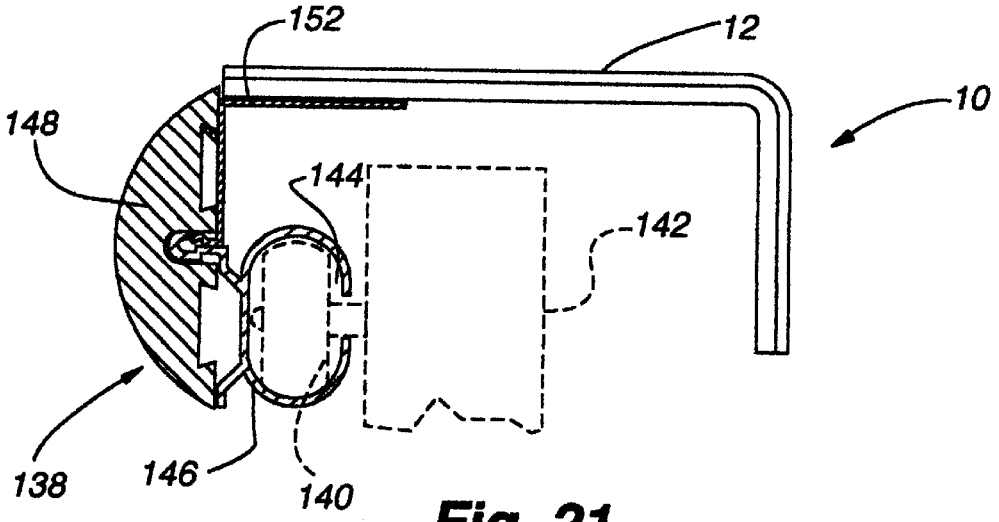
FIG. 21 is a cross sectional view of a facade and drapery track combination as attached to the universal bracket assembly.
Figure 22:
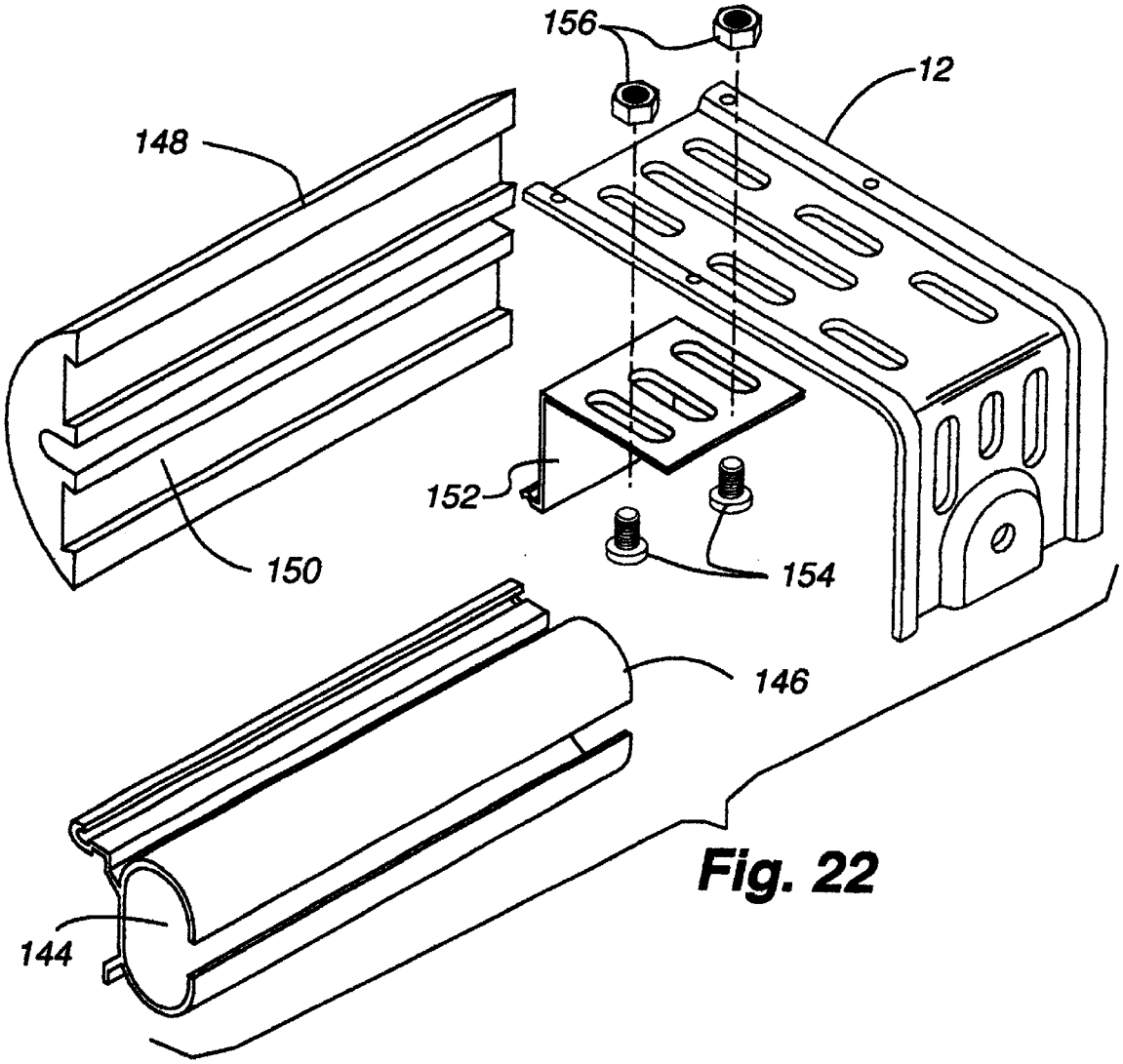
FIG. 22 is an exploded isometric view illustrating the manner in which the facade and drapery track of FIG. 21 is attached to the universal bracket assembly.

FIGS. 21 and 22 illustrate a facade and drapery track headrail 138 of a type currently found in the marketplace. Rollers 140 that are attached to drapery coverings 142 via drapery brackets (not shown) are received into the generally tubular opening 144 of the drapery track 146 such that draperies can be easily opened and closed As shown, the facade and drapery track combination 138 comprises (1) a semicircular facade piece 148 to which a drapery track 146 attaches to the lower half of the facade piece's rear surface 150, and (2) a mounting bracket 152 that attaches to the upper half of the rear surface 150. The mounting bracket 152 is secured to the long leg 28 of the L-shaped base 12 through the frontmost pair of slots 36 with screw fasteners 154 and a pair of nuts 156. As can be appreciated, the top and lower covers 20 and 22 of the bracket assembly can be installed over the L-shaped base as desired.

Figure 23:
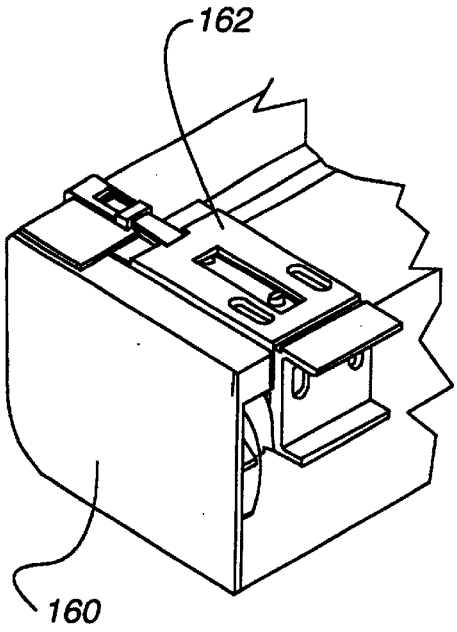
FIG. 23 is isometric top view of a portion of a motorized retractable shade headrail attached to its supplied mounting bracket.
Figure 24:
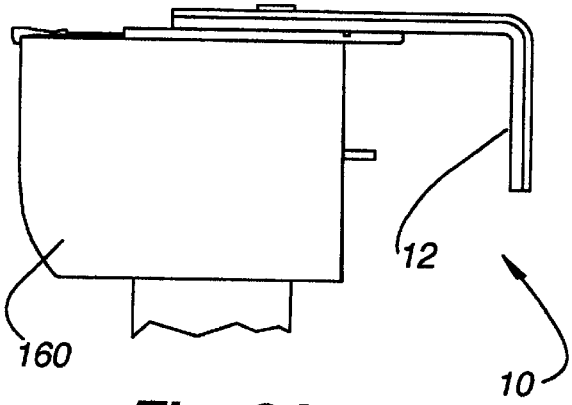
FIG. 24 is an end view of the motorized retractable shade headrail mounted to the universal bracket assembly.
Figure 25:
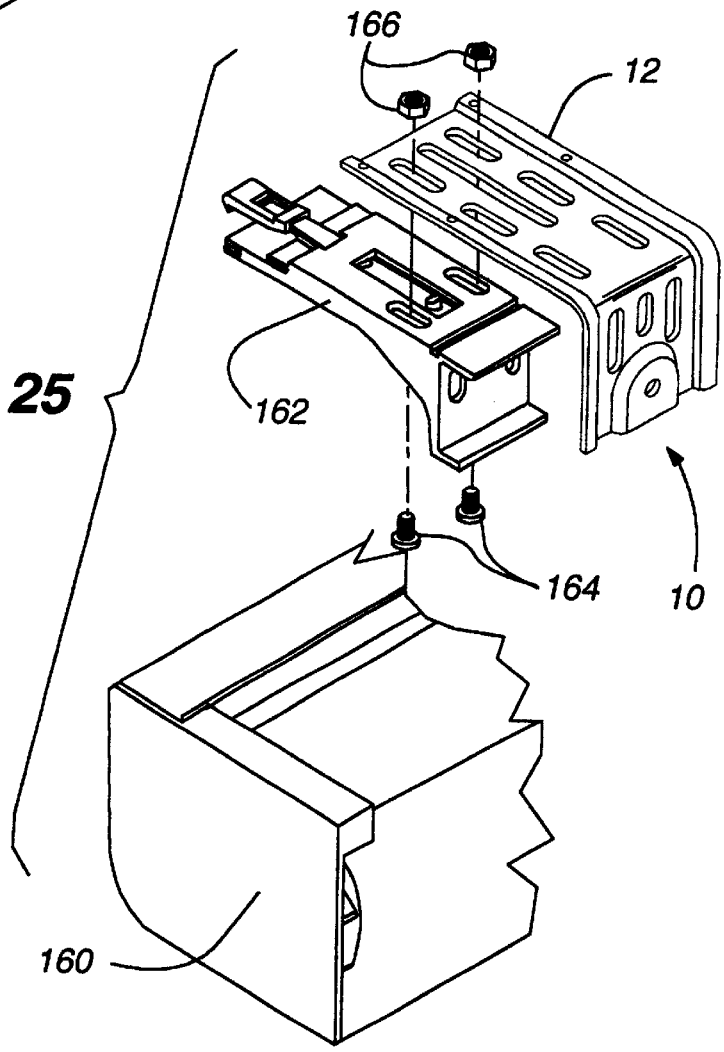
FIG. 25 is an exploded isometric view illustrating the manner in which the motorized retractable shade headrail of FIG. 24 is attached to the universal bracket assembly.

FIGS. 23–25 illustrate a headrail 160 of a motorized roller shade that is also commercially available mounted to the universal bracket assembly 10. The as-supplied mounting bracket 162 is secured to the L-shaped base 12 through a pair of slots 36 using fasteners 164 and nuts 166. The headrail 160 is then attached to the as-supplied bracket 162 as is illustrated specifically in FIG. 23. As is to be appreciated, the top and lower covers 20 and 22 can be utilized as desired.

Figure 26:
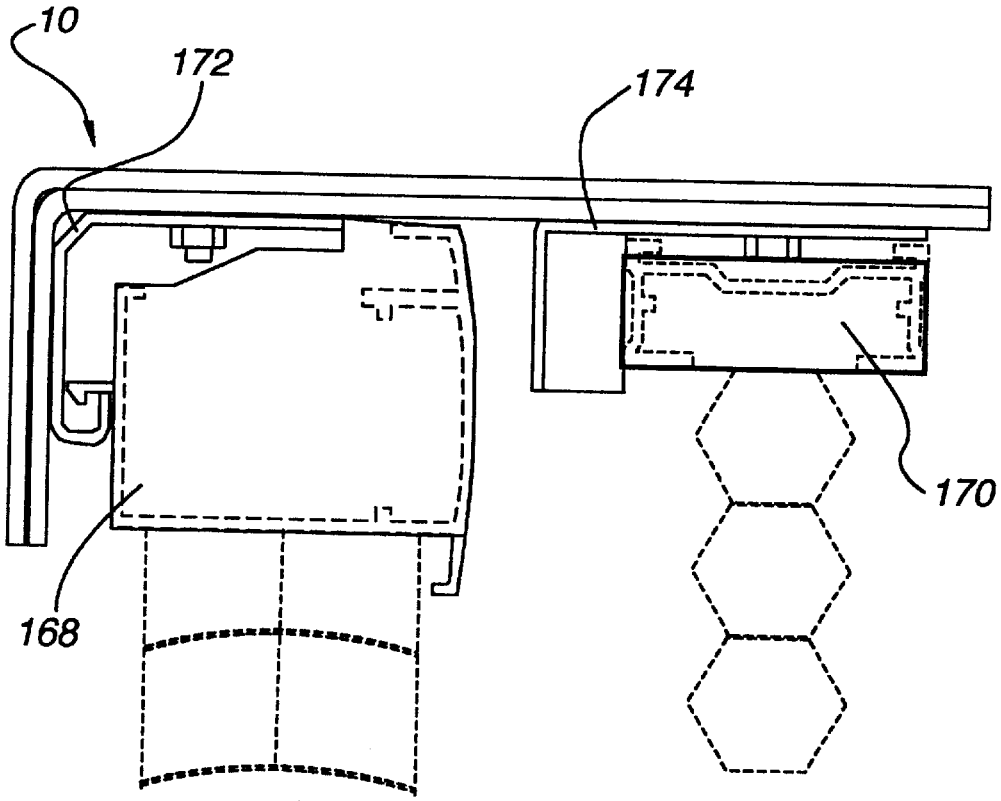
FIG. 26 is a cross-sectional view illustrating two architectural covering mounted to a single universal bracket assembly.
Figure 27:
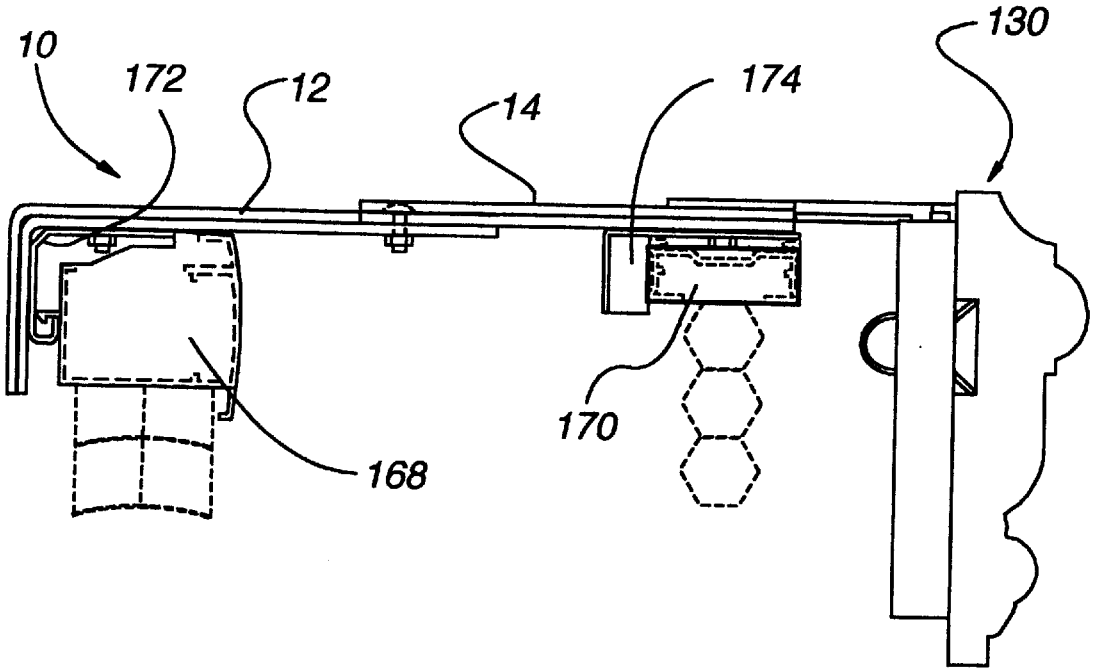
FIG. 27 is cross sectional view illustrating a universal bracket utilizing the extension plate with two architectural coverings and a facade attached thereto.

FIGS. 26 and 27 illustrate two variations of the universal bracket assembly 10 wherein the headrails of two architectural opening coverings are attached to each universal bracket assembly. Referring to FIG. 26, both a Venetian blind assembly 168 and a honeycomb shade assembly 170 are mounted to an L-shaped base 12. The as-supplied bracket 172 for the Venetian blind assembly 168 is mounted to the long leg 28 through either the center slot 38 or a pair of slots 36 provided therein, although alternatively, the as-supplied bracket 172 can be mounted to the slots 68 and 70 in the short leg 26 as well. The as-supplied bracket 174 for the honeycomb shade assembly 170 is mounted in front of the bracket 172 for the Venetian blind assembly 130 and is secured to long leg 28 via fasteners and nuts through either a pair of slots 36 or the center slot 38 in the long leg 28. Although not shown the top and front covers 20 and 24 may be utilized to give the universal bracket assembly a more pleasing appearance.

Referring to FIG. 27, a Venetian blind assembly 168 and a honeycomb shade assembly 170 are mounted to a universal bracket assembly 10 utilizing the extension plate 14, thereby increasing the horizontal distance between the two coverings. Furthermore, a facade assembly 130 is mounted to the front of the extension plate to hide the headrails of the coverings from view.

Although preferred embodiments of this invention have been described above, those skilled in the art could make numerous alterations to the disclosed embodiments without departing from the spirit or scope of this invention. Further, all directional references used above are provided only to aid the reader's understanding of the present invention, but should not create limitations, particularly as to the orientation of the apparatus. It is intended that all matter contained in the above description or shown in the accompanying drawings shall be interpreted as illustrative only and not limiting.

What is claimed is:

1. A bracket assembly for mounting a covering for an architectural opening to a vertical surface comprising:

an L-shaped base, the L-shaped base comprising a substantially vertical leg and an elongated substantially horizontal leg, the horizontal leg including opposing first and second longitudinal edges, a first lateral end intersecting with the vertical leg, a second lateral end opposite the first lateral end, substantially horizontal top and bottom surfaces, and a plurality of vertically-extending openings disposed on the horizontal leg, the openings being adapted to receive fasteners for mounting one or more architectural coverings, the horizontal leg further comprising a rule marked on one of the top and bottom surfaces proximate one of the first and second longitudinal edges, the vertical leg including left and right opposing vertical edges, substantially vertical front and rear surfaces, and at least one horizontally-extending opening passing therethrough, the opening adapted for receiving a fastener to fixedly attach the L-shaped base to a vertical surface; and a substantially vertically orientated facade, the facade being coupled with the L-shaped base proximate the second lateral end.

2. The bracket assembly of claim 1, wherein at least one or more of the plurality of openings comprise longitudinally orientated slots.

3. The bracket assembly of claim 1, further comprising a top cover, the top cover having an upwardly facing side and longitudinal edges and being adapted to wrap around and over the first and second longitudinal edges of the L-shaped base, wherein the top surface of the horizontal leg is substantially covered by the top cover.

4. The bracket assembly of claim 3, wherein the upwardly facing side of the top cover has an arcuate lateral cross section.

5. The bracket assembly of claim 3, further comprising a front cover, the front cover having a front side and an attachment mechanism, the front side substantially covering the first lateral end of the horizontal leg, and the attachment mechanism securing the front cover to the L-shaped base.

6. The bracket assembly of claim 1, further comprising a lower cover, the lower cover having a front side and an attachment mechanism, the front side substantially covering the front surface of the vertical leg, and the attachment mechanism securing the lower cover to the L-shaped base.

7. A bracket assembly for mounting a covering for an architectural opening to a vertical surface comprising:

an L-shaped base, the L-shaped base comprising a substantially vertical leg and an elongated substantially horizontal leg, the horizontal leg including opposing first and second longitudinal edges, a first lateral end intersecting with the vertical leg, a second lateral end opposite the first lateral end, substantially horizontal top and bottom surfaces, and a plurality of vertically-extending openings disposed on the horizontal leg, the openings being adapted to receive fasteners for mounting one or more architectural coverings, the horizontal leg further comprising a rule marked on one of the top and bottom surfaces proximate one of the first and second longitudinal edges, the vertical leg including left and right opposing vertical edges, substantially vertical front and rear surfaces, and at least one horizontally-extending opening passing therethrough, the opening adapted for receiving a fastener to fixedly attach the L-shaped base to a vertical surface;

an elongated substantially horizontal extension plate, the extension plate having substantially horizontal top and bottom surfaces, opposing first and second longitudinal edges, first and second lateral edges and a plurality of vertically-extending openings disposed on the extension plate, the openings being adapted to receive fasteners for mounting one or more coverings for architectural openings, wherein at least a portion of one of the top and bottom surfaces of the extension plate is in contact with and overlies or underlies a portion of one of the top and bottom surfaces of the horizontal leg, at least one opening of the horizontal leg and at least one opening of the extension plate being at least partially aligned and having a fastener passing therethrough; and a substantially vertically orientated facade, the facade being coupled with the extension plate.

8. The bracket assembly of claim 7, wherein the extension plate further comprises a rule marked on one of the top and bottom surfaces proximate one of the first and second longitudinal edges.

9. A window covering assembly comprising:

a first window covering having a first headrail;

a first headrail bracket, the first headrail bracket being fixedly attached to the headrail and having at least one hole for receiving a fastener;

a mounting bracket, the mounting bracket comprising a first section and a second section, the first section having a hole for receiving a fastener to attach the mounting bracket to a vertical surface, the second section having a plurality of openings disposed therethrough for receiving fasteners;

a first fastener passing through both the at least one hole in the first headrail bracket and a first opening of the plurality of openings in the mounting bracket, fixedly attaching the first headrail bracket to the mounting bracket; and a vertically orientated facade, the facade being coupled with the mounting bracket.

10. The assembly of claim 9, wherein the second section of the mounting bracket further comprises a longitudinal rule marked on the second section.

11. The assembly of claim 9, wherein the first section is substantially perpendicular to the second section.

12. The assembly of claim 9, wherein the mounting bracket further comprises an extension section, the extension section comprising a plurality of openings disposed thereon, at least one opening of the plurality of openings of the extension section being aligned with at least one opening of the plurality of openings of the second section, wherein a second fastener is received through the aligned openings, securing the extension section to the second section.

13. The assembly of claim 12, wherein the extension section further comprises a longitudinal rule marked thereon.

14. The assembly of claim 12, wherein the substantially vertically orientated facade is attached to the extension section.

15. A window covering assembly comprising:

a first window covering having a first headrail;

a first headrail bracket, the first headrail bracket being fixedly attached to the headrail and having at least one hole for receiving a fastener;

a single set of mounting bracket assemblies, a first mounting bracket assembly of the single set of mounting bracket assemblies comprising a first section and a second section, the first section having a hole for receiving a fastener to attach the mounting bracket to a vertical surface, the second section having a plurality of openings disposed therethrough for receiving fasteners;

a first fastener passing through both the at least one hole in the first headrail bracket and a first opening of the plurality of openings in the first mounting bracket assembly, fixedly attaching the first headrail bracket to the first mounting bracket assembly;

second window covering having a second headrail;

second headrail bracket attached to the second headrail, the second headrail bracket having at least one hole for receiving a fastener; and third fastener passing through both the at least one hole in the second headrail bracket and a second opening of the plurality of openings in the second section of the first mounting bracket assembly, fixedly attaching the second headrail bracket to the first mounting bracket assembly.

16. The window covering assembly of claim 15, wherein the second section of the mounting bracket further comprises a longitudinal rule marked on the second section.

17. The window covering assembly of claim 15, wherein the second section of the first mounting bracket assembly further comprises an extension plate.

18. The window covering assembly of claim 17, wherein the extension plate further comprises a longitudinal rule marked thereon.

19. The window covering assembly of claim 15, wherein the first section is substantially perpendicular to the second section.

20. The window covering assembly of claim 15, further comprising a vertically orientated facade, the facade being coupled with the first mounting bracket assembly.

21. A bracket assembly for mounting one or two of a large population of coverings for architectural openings to a vertical surface, the assembly comprising an L-shaped base, the L-shaped base comprising a substantially vertical leg and an elongated substantially horizontal leg, the horizontal leg including opposing first and second longitudinal edges, a first lateral end intersecting with the vertical leg, a second lateral end opposite the first lateral end, substantially horizontal top and bottom surfaces, and a plurality of vertically-extending openings disposed on the horizontal leg, the openings being adapted to receive fasteners for mounting one or more architectural coverings, the vertical leg including left and right opposing vertical edges, substantially vertical front and rear surfaces, and at least one horizontally-extending opening passing therethrough, the opening adapted for receiving a fastener to fixedly attach the L-shaped base to a vertical surface, wherein the vertically-extending openings include (i) a longitudinally-extending center slot being positioned between the first and second longitudinal edges along a longitudinal axis, the center slot extending about 1.875" and being about 0.195" wide, and (ii) three pairs of longitudinally aligned slots, each pair of longitudinally-aligned slots being spaced from and laterally aligned with at least one adjacent pair of longitudinally-extending slots of the three longitudinally-extending pairs of slots, each slot of each pair having a front and rear end, one slot of each pair being laterally spaced about 0.39" to the right of the longitudinal axis and the other slot of each pair being spaced about 0.39" to the left of the longitudinal axis, each slot of the three pairs being about 0.70" long.

22. The assembly of claim 21 further comprising an elongated substantially horizontal extension plate, the extension plate being adapted to couple with the horizontal leg in an overlapping relationship and having substantially horizontal top and bottom surfaces, opposing first and second longitudinal edges, first and second lateral edges and a plurality of vertically-extending openings disposed on the extension plate, the openings being adapted to receive fasteners for mounting with one or more coverings for architectural openings, the vertically-extending openings of the extension plate including (i) one or more center slots positioned between the first and second longitudinal edges of the extension plate along an extension plate longitudinal axis, the center slots being about 0.195" wide and, (ii) a plurality of spaced, longitudinally-aligned pairs of slots, each pair of slots being laterally aligned with one or more adjacent longitudinally-aligned pair of slots, one slot of each pair being located about 0.39" to the right of the extension plate longitudinal axis and the other slot being located about 0.39" to the left of the extension plate longitudinal axis, each slot of the plurality of longitudinally-aligned pairs of slots being about 0.195" wide.

23. The bracket assembly of claim 22, wherein the horizontal extension plate includes a longitudinal rule marked thereon.

24. The bracket assembly of claim 22, further comprising a substantially vertically orientated facade, the facade being coupled with the extension plate.

25. The assembly of claim 21, wherein the at least one horizontally-extending opening in the vertical leg includes (i) a substantially round mounting hole positioned along a vertical center axis, the hole being about 0.195" in diameter, (ii) a center slot extending along the vertical center axis, the center slot being spaced from the mounting hole and being about 0.195" wide, (iii) at least one pair vertically-aligned slots, each slot being about 0.195" wide and wherein one slot of the pair is spaced about 0.39" to the left of the vertical center axis and the other slot is spaced about 0.39" from the right of the vertical center axis.

26. The bracket assembly of claim 21, wherein the horizontal leg of the L-shaped base includes a longitudinal rule marked thereon.

27. The bracket assembly of claim 21, further comprising a substantially vertically orientated facade, the facade being coupled with the L-shaped base proximate the second lateral end.

* * * * *